United States Patent [19]

Noguchi et al.

[11] Patent Number: 4,508,039

[45] Date of Patent: Apr. 2, 1985

[54] METHOD OF AND SYSTEM FOR INCINERATING SLUDGE

[75] Inventors: Tetsuo Noguchi; Kanji Kuwabara, both of Shizuoka, Japan

[73] Assignee: Kabushiki Kaisha Okawara Seisakusho, Shizuoka, Japan

[21] Appl. No.: 600,470

[22] Filed: Apr. 16, 1984

[30] Foreign Application Priority Data

Apr. 22, 1983 [JP] Japan ..... 58-71645

[51] Int. Cl.[3] ..... F23G 5/00

[52] U.S. Cl. ..... 110/258; 110/238; 110/259; 110/346

[58] Field of Search ..... 110/238, 346, 258, 347, 110/259

[56] References Cited

U.S. PATENT DOCUMENTS

| | | | |
|---|---|---|---|
| 3,824,935 | 7/1974 | Yamoto et al. | 110/258 |
| 4,043,280 | 8/1977 | Wray et al. | 110/258 X |
| 4,159,000 | 6/1979 | Iwasaki et al. | 110/258 X |
| 4,245,570 | 1/1981 | Williams | 110/238 |
| 4,429,643 | 2/1984 | Mulholland | 110/238 |

*Primary Examiner*—Edward G. Favors

*Attorney, Agent, or Firm*—Bucknam and Archer

[57] ABSTRACT

In an incinerator for sludge, an amount of air, ranging from a half to one times as much as a theoretical amount of air needed to combustion of the sludge, is gently blown from at least one arm to the sludge while the latter is being stirred by the stirring arm, thereby burning the sludge mildly. Reducible exhaust gas produced during the incineration is mixed with added air for a secondary combustion.

5 Claims, 7 Drawing Figures

METHOD OF AND SYSTEM FOR INCINERATING SLUDGE

BACKGROUND OF THE INVENTION

1. Field of the Invention

The present invention relates to a method of and system for incinerating sludge.

2. Description of the Prior Art

Sludge is generally composed of minute particles and hence would not allow air to circulate through the inter-particle spaces during combustion, causing inefficient and non-uniform incineration. To facilitate incineiation, it has been a common practice that an amount of air, ranging from two to two and a half times as much as a theoretical amount of air needed to combustion of the sludge, is blown for the sludge while the latter is stirred in the incinerator. However, in this conventional method, when such large amount of air is blown to it, the sludge would be burned suddenly so that the temperature of parts of the sludge increases to over 1,200° C. As a result, clinker would be produced in the incinerator; clinker is in the form of very hard lumps of ashes which not only are difficult to be burned up, but also retard the combustion of the remaining sludge, thus causing inefficient incineration and non-stable operation of the incinerator.

Otherwise, if a reduced amount of air were supplied into the incinerator in an attempt to minimize the production of clinker, the incinerator would be rather much more overheated due to insufficient cooling ability by air and, as a result, there would be a danger that clinker is developed all over the bottom of the incinerator in stead of being minimized. In this condition, stable operation of the incinerator for a long time is difficult to achieve.

SUMMARY OF THE INVENTION

According to the present invention, an amount of air, ranging from a half to one times as much as a theoretical amount of air needed to combustion of sludge, is gently blown from at least one stirring arm to the sludge while the latter is being stirred by the stirring arm in an incinerator, thereby burning the sludge mildly. Reducible exhaust gas produced during the incineration is mixed with added air for a secondary combustion.

It is therefore an object of the present invention to provide a method of and a system for incinerating sludge gently with no developing of clinker, guaranteeing uniform and efficient combustion.

Many other objects, features and additional advantages of the present invention will become manifest to those versed in the art upon making reference to the detailed description and the accompanying drawings in which preferred embodiments incorporating the principles of the present invention are shown by may of illustrative example.

BRIEF DESCRIPTION OF THE DRAWINGS

FG. 6 is an enlarged horizontal cross-sectional view showing a sludge-discharge outlet of the incinerator of FIG. 5.

DETAILED DESCRIPTION

Figure 1:
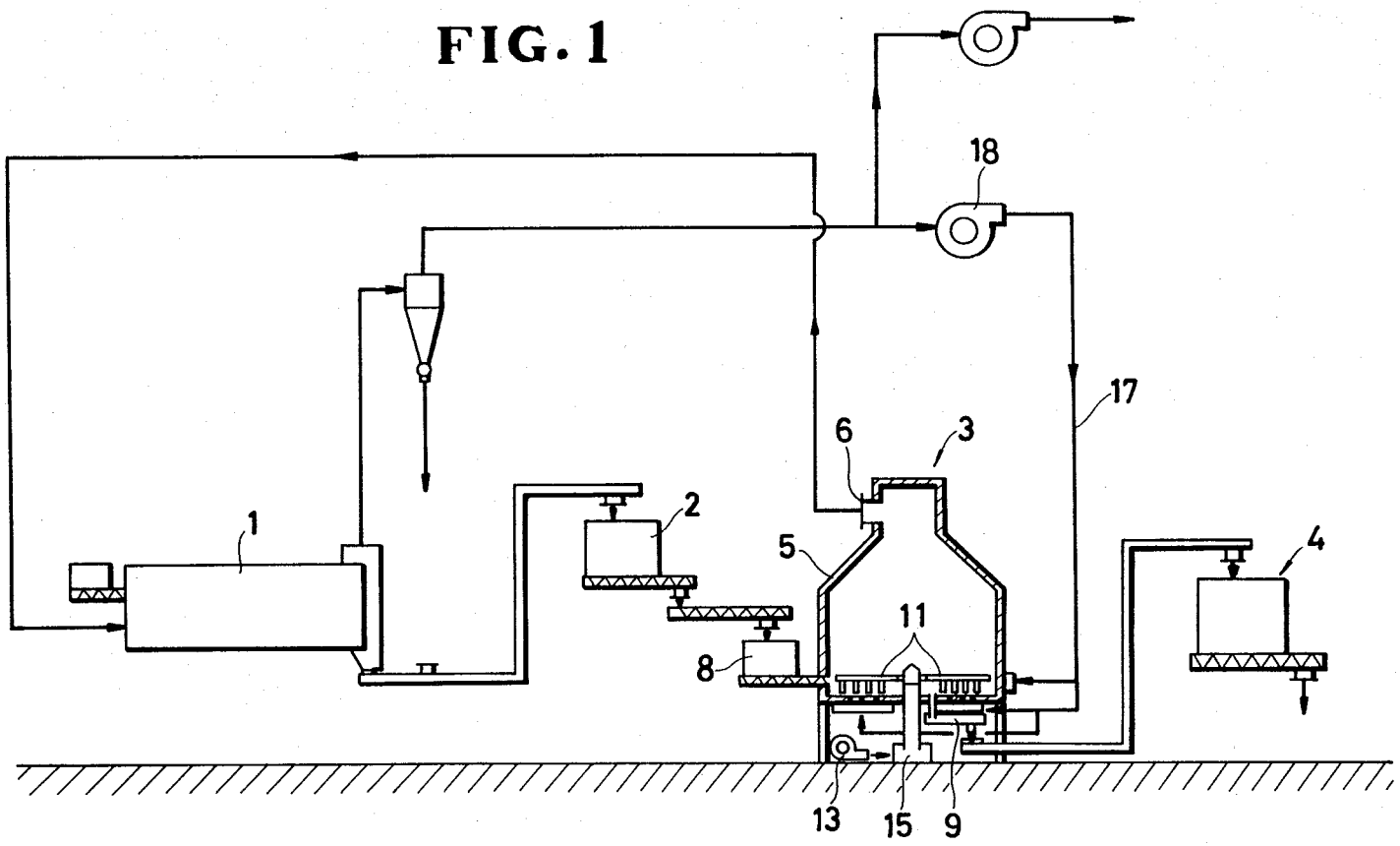
FIG. 1 is a diagramatic view showing a sludge-incinerating system embodying the present invention.

The principles of the present invention are particularly useful when embodied in a sludge-incinerating system (hereinafter referred to as "system") such as shown in FIG. 1. The system generally comprises a dryer 1, a first or intermediate hopper 2, an incinerator 3, and a second or ash hopper 4.

The dryer 1 may be of any known type such as a rotary cylindrical type. The sludge having been predried in the dryer 1 is fed to the intermediate hopper 2 for temporary storage therein. From the intermediate hopper 2, a predetermined amount of the sludge, at a time, is supplied to the incinerator 3, in which the sludge is burned into ashes. The ashes thus produced are removed from a bottom 22 (FIG. 3) of the incinerator 3 and are then stored in the ash hopper 4. Meanwhile, a high-humidity, low-oxygen-concentration gas discharged from the dryer 1 is partially fed to the incinerator 3, and is mixed with a reducible exhaust gas (produced during the initial combustion) in the incinerator 3 for a secondary combustion. A portion of exhaust gas discharged from the incinerator 3 is in turn supplied to the dryer 1 as a heating medium.

Figure 2:
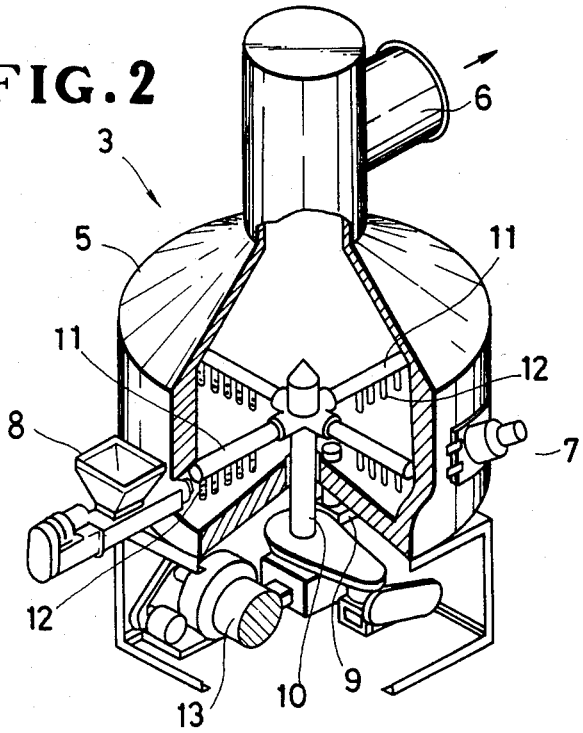
FIG. 2 is a perspective view, with parts broken away, of an incinerator.
Figure 3:
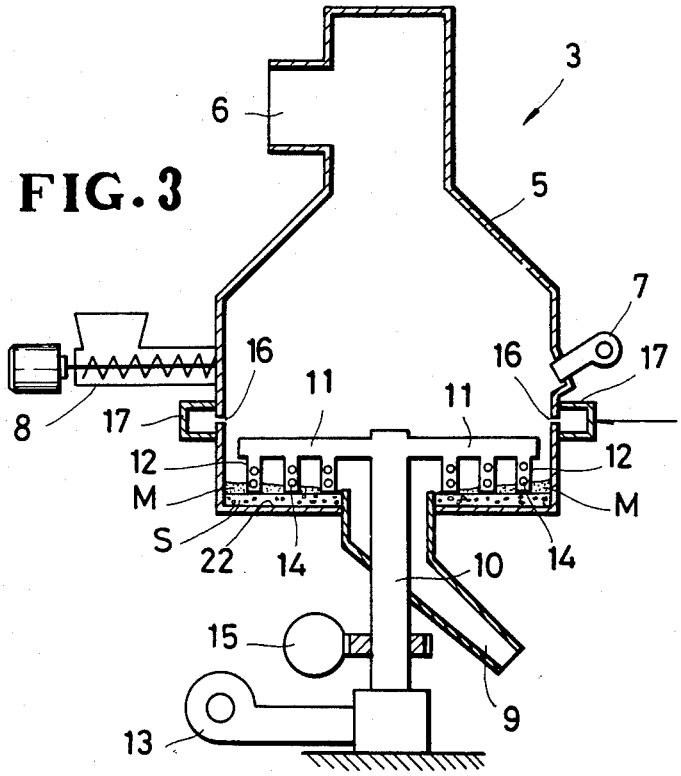
FIG. 3 is a vertical cross-sectional view of the incinerator of FIG. 2.

As shown in FIGS. 2 and 3, the incinerator 3 includes a body 5 of circular horizontal cross section having at its top an exhaust port 6, an auxiliary burner 7, a feeder 8 for introducing the dried sludge M into the incinerator 3, and an outlet 9 through which ashes are discharged from the incinerator 3.

The incinerator 3 also includes a sludge stirring means which serves to prevent the introduced sludge M from collecting into lumps and dispersing. The stirring means also serves to assist in exposing the sludge to air, thus causing uniform and gentle incineration. The stirring means includes a hollow rotatable shaft 10 extending centrally through the bottom 22, and two or more hollow wings 11 extending radially outwardly from the upper end of the shaft 10, each of the wings 11 having a plurality of hollow stirring arms 12 projecting downwardly therefrom and terminating short of the bottom 22 of the incinerator 3. The shaft 10 is driven by a drive 15 for rotation. A blower 13 is connected to the lower end of the shaft 10 for gently blowing an amount of air, ranging from a half to one times as much as a theoretical amount of air needed to combustion of the sludge, from a plurality of openings 14 of each stirring arm 12 to the sludge M.

The body 5 of the incinerator 3 has in its perpheral wall a plurality of openings 16 disposed at a level ranging from 200 to 400 mm above the surface of ash layer and spaced circumferentially at angular distances of from 40 to 60 degrees with respect to the center of the body 5. A blower 18 (FIG. 1) is connected to the openings 16 via an exhaust dust 17 for supplying a portion of exhaust gas from the dryer 1 to the incinerator 3 for a secondary combustion. As the exhaust gas from the dryer 1 is utilized as a secondary combustion air, imflamable and odorous gases contained in that exhaust gas are eliminated.

Over the bottom 22 of the incinerator 3, a layer S of sand and/or small stones (hereinafter referred to as "sand layer") is formed, the thickness of the sand layer S being larger than the maximum height of clinker produced in the incinerator 3 and of solid materials contained in the sludge M. If the distance between the bottom 22 of the incinerator 3 and the lower ends of the stirring arms 12 were small, there would be a danger that the clinker or the above-mentioned solid material are jammed between the incinerator's bottom 22 and the stirring arms 12, thus often making the sludge-stirring means inoperable. The sand layer S serves as an apparent bottom (of the incinerator) to prevent the sludge and the solid materials from jamming. This sand layer S also allows the lower ends of the stirring arms 12 to be disposed close to or in contact with the surface of the apparent bottom so that virtually all part of the sludge is stirred so as to be exposed to air, thus resulting in uniform combustion. Since the temperature of the surface of the sand layer S reaches the several hundred degrees C. during the incineration, such potential heat would absorb changes in temperature and load of the incinerator 3 due to varying amount, water content and calorific value of sludge to be incinerated, guaranteeing stable combustion. Further, the sand layer S serves as a thermal insulator to protect the bottom 22 of the incinerator 3 from being overheated; the fireproof requirements of the structure of the incinerator's bottom 22 may therefore be minimized.

In operation, as shown in FIG. 1, sludge is first introduced into the dryer 1 and, at the same time, a heating medium, i.e. a fresh air preheated and a high-temperature exhaust gas discharged from the incinerator 3, is supplied to the dryer 1 to dry the sludge. The dried sludge is then fed to the intermediate hopper 2 for temporary storage therein. A predetermined amount of the dried sludge M (FIG. 3) is supplied to the incinerator 3 and, at the same time, an amount of air, ranging from a half to one times as much as a theoretical amount of air needed for combustion of the sludge, is gently blown from the openings 14 of the stirring arms 12 to the sludge M as the shaft 10 is in rotation to stir the sludge M by the stirring arms 12. As a result, the sludge M is virtually entirely stirred and exposed to the air for combustion.

Subsequently, a high-humidity (0.1 to 0.5 Kg $H_2O$/Kg dry air), low-oxygen-concentration (13 to 17%) exhaust gas (discharged from the dryer 1) is blown to the sludge M in the incinerator 3 through the openings 16 in the incinerator's peripheral wall, burning the sludge gently with no development of clinker. Thus the sludge M, though gently burned, is incinerated entirely uniformly, causing much more efficient combustion than that by supplying an excessive amount of air (in the conventional system).

Reducible exhaust gas having developed during the incineration is removed from the incinerator 3; a portion of the exhaust gas is discharged to the exterior, while the remaining exhaust gas is supplied to the dryer 1 as a heating medium.

According to the present invention, since the sludge is gently burned with an amount of air ranging from a half to one times as much as a theoretical amount of air needed for combustion of the sludge, combustion takes place at a temperature far below the temperature at which clinker would be produced. In this condition, the sludge would remain its particulate or powdery form until it is burned up into ashes; this means, the areas of the sludge which are open to exposure to air would remain extremely large all through the incineration. Accordingly, it is possible to incinerate the sludge with improved efficiency.

Figure 4:
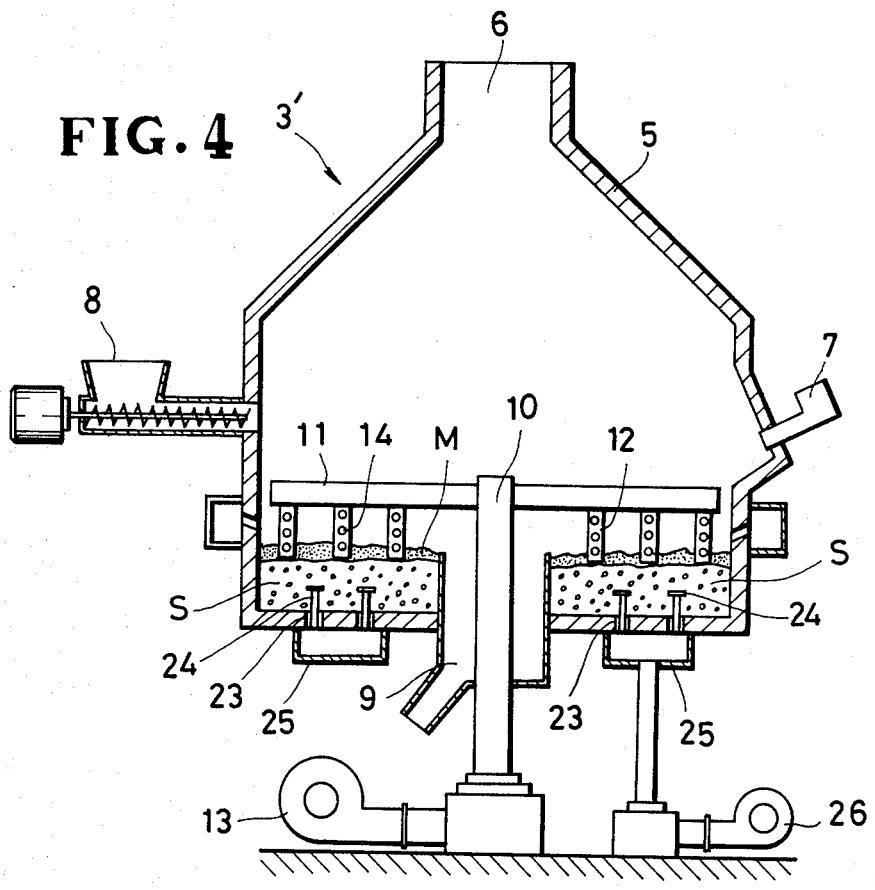
FIG. 4 is a vertical cross-sectional view similar to FIG. 3, showing a modified form of the incinerator.

FIG. 4 illustrates a modified incinerator 3' having a plurality of nozzles 24 projecting through a plurality of openings 23, respectively, of the bottom 22 into the sand layer S. The nozzles 24 communicate with a blower 26 via a duct 25 for introducing the exhaust gas (from the dryer 1) into the sand layer S. This arrangement facilitates exposing of the sludge to air to minimize the occurrence of clinker, thus guaranteeing uniform and efficient combustion.

Figure 5:
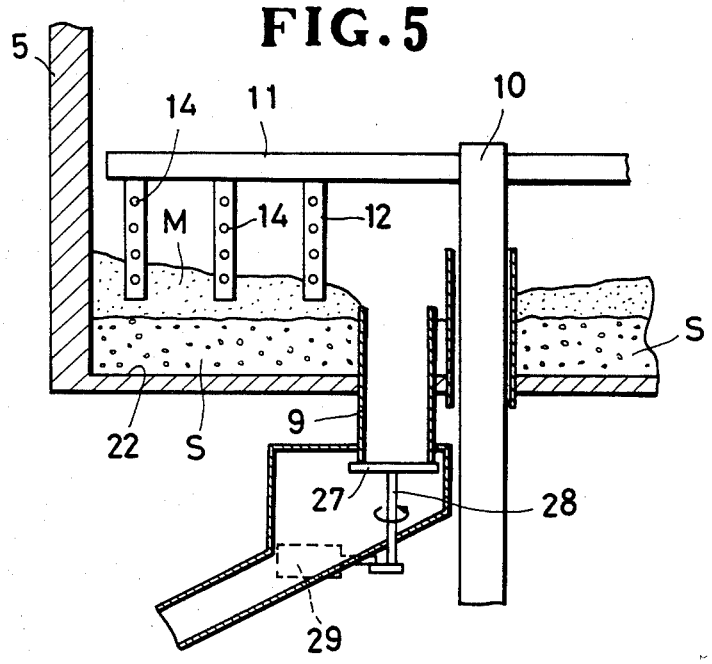
FIG. 5 is an enlarged fragmentary cross-sectional view showing another modified form of the incinerator.
Figure 6:
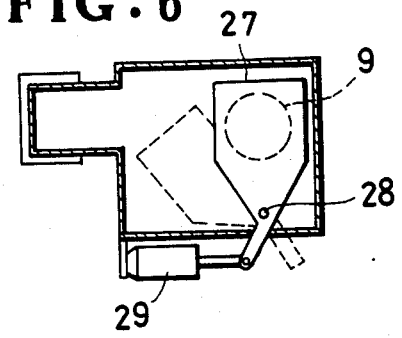
Figure 7:
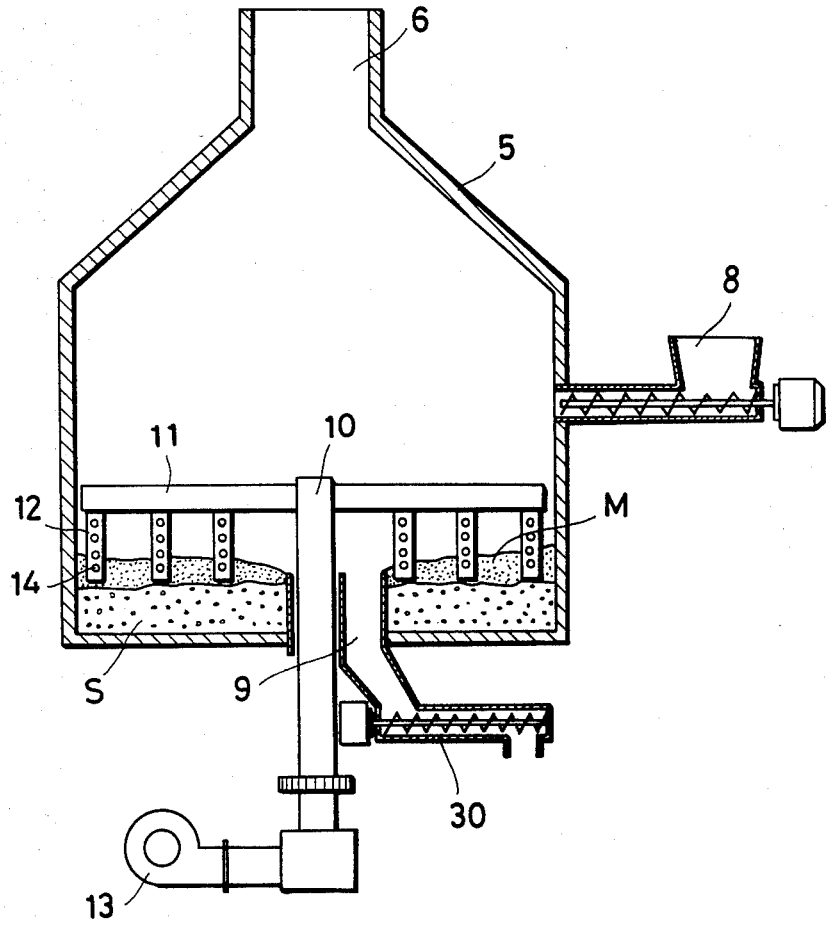
FIG. 7 is a vertical cross-sectional view showing still another modified form of the incinerator.

FIGS. 5 and 6 illustrate another modification in which the lower end of the ash outlet 9 is intermittently closed with a closure plate 27. The closure plate 27 is operatively connected with an air-pressurized cylinder 29, and is intermittently pivotable through a predetermined angle about a rotatable shaft 28. The ashes are stored temporarily in the ash outlet 9 and is then discharged intermittently to the exterior. With this arrangement, incompletely burned material fallen into the ash outlet 9 is further burned for complete combustion during the temporary stay in the ash outlet 9. In an embodiment of FIG. 7, the ashes are discharged intermittently or continuously to the exterior by means of a screw conveyor 30.

If sludge to be incinerated is in muddy form containing much water, it is advantageous that a portion of the ashes is mixed with the fresh sludge. This mixture would be of lower water content and hence would tend to disperse for being easily burned, partly because a portion of water contained in the sludge vapors due to potential heat of the added ashes, and the other portion of the water of the sludge is transferred to the added ashes.

Although various minor modifications may be suggested by those versed in the art, it should be understood that we with to embody within the scope of the patent warranted hereon, all such embodiments as reasonably and properly come within the scope of our contribution to the art.

What is claimed is:

1. A method of incinerating sludge, comprising the steps of:

(a) predrying the sludge in a dryer;

(b) introducing the predried sludge into an incinerator;

(c) stirring the introduced sludge in the incinerator by at least one stirring arm; and (d) concurrently with said stirring, blowing an amount of air, ranging from a half to one times as much as a theoretical amount of air needed for combustion of the sludge, from said stirring arm to the sludge to burn the latter gently, and (e) further blowing an exhaust gas of high humidity and low oxygen concentration to the sludge in the incinerator for being mixed with a reducible exhaust gas, which is produced during an initial combustion in the incinerator, to thereby burn the sludge at a temperature below 1,200° C.

2. A system for incinerating sludge, comprising:

(a) an incinerator including a body of circular horizontal cross section in which the sludge is to be placed for combustion, said body having a peripheral wall and a bottom, said peripheral wall having a plurality of first openings spaced apart circumferentially from one another, said bottom having a plurality of second openings;

(b) a first blower connected to said first openings for blowing air to the sludge;

(c) means, for stirring the sludge, including a rotatable vertical shaft extending centrally through said bottom, and at least two wings extending radially outwardly from an upper end of said shaft, each of said wings having a plurality of parallel stirring arms projecting downwardly therefrom and terminating short of said bottom of said incinerator, each of said stirring arms having a plurality of third openings, said shaft being operatively connected with a drive for rotation, all of said shaft and said wings and said stirring arms being of hollow configuration and communicating with one another;

(d) a second blower connected to a lower end of said shaft for blowing air to the sludge through said stirring arms via said shaft and wings; and further including a sand layer of sand or small stones overlying said bottom of said incinerator as an apparent bottom, the lower end of said stirring arm being disposed close to or in contact with said sand layer.

3. An incinerating system according to claim 2, further including a plurality of nozzles each projecting through a respective one of said second openings of said bottom into said sand layer, said nozzles being connected to a third blower via a duct for introducing air into said sand layer.

4. A system for incinerating sludge, comprising:

(a) an incinerator including a body of circular horizontal cross section in which the sludge is to be placed for combustion, said body having a peripheral wall and a bottom, said peripheral wall having a plurality of first openings spaced apart circumferentially from one another, said bottom having a plurality of second openings;

(b) a first blower connected to said first openings for blowing air to the sludge;

(c) means, for stirring the sludge, including a rotatable vertical shaft extending centrally through said bottom, and at least two wings extending radially outwardly from an upper end of said shaft, each of said wings having a plurality of parallel stirring arms projecting downwardly therefrom and terminating short of said bottom of said incinerator, each of said stirring arms having a plurality of third openings, said shaft being operatively connected with a drive for rotation, all of said shaft and said wings and said stirring arms being of hollow configuration and communicating with one another;

(d) a second blower connected to a lower end of said shaft for blowing air to the sludge through said stirring arms via said shaft and wings; and further including, in said bottom of said incinerator, as ash outlet from which ashes produced in the incinerator are to be removed, said ash outlet being provided with means for temporarily halting the ashes in said ash outlet and then discharging the ashes intermittently or continously to the exterior;

said temporarily halting and discharging means comprising a pivotably closure plate for intermittently closing the lower end of said ash outlet, and an air-pressurized cylinder operatively connected with said closure plate an doperable to intermittently drive the latter to pivot through a predetermined angle.

5. A method according to claim 1, wherein said exhaust gas of high humidity and low oxygen concentration is produced in the dryer during said predrying.

* * * * *